US006982729B1

(12) United States Patent
Lange et al.

(10) Patent No.: US 6,982,729 B1
(45) Date of Patent: Jan. 3, 2006

(54) CONSTANT SIZE IMAGE DISPLAY INDEPENDENT OF SCREEN RESOLUTION

(75) Inventors: Peter J Lange, Windsor, CO (US); Robert E Chalstrom, Fort Collins, CO (US); Melvin Brent Wilkins, Fort Collins, CO (US)

(73) Assignee: Hewlett-Packard Development Company, LP., Houston, TX (US)

( * ) Notice: Subject to any disclaimer, the term of this patent is extended or adjusted under 35 U.S.C. 154(b) by 0 days.

(21) Appl. No.: 09/552,060

(22) Filed: Apr. 19, 2000

(51) Int. Cl.
*G09G 5/02* (2006.01)

(52) U.S. Cl. ..... 345/660; 345/3.4

(58) Field of Classification Search ..... 345/660, 345/668, 669, 661, 3.4; 709/228
See application file for complete search history.

(56) References Cited

U.S. PATENT DOCUMENTS

| | | | | |
|---|---|---|---|---|
| 5,172,103 | A * | 12/1992 | Kita | 345/668 |
| 6,067,071 | A * | 5/2000 | Kotha et al. | |
| 6,212,564 | B1 * | 4/2001 | Harter et al. | 709/228 |
| 6,281,874 | B1 * | 8/2001 | Sivan et al. | 345/660 |
| 6,310,601 | B1 * | 10/2001 | Moore et al. | 345/660 |
| 6,339,434 | B1 * | 1/2002 | West et al. | 345/667 |

* cited by examiner

*Primary Examiner*—Matthew Luu

(57) ABSTRACT

A method and apparatus for displaying images on web pages at a constant size, independent of screen resolution and independent of physical screen size is disclosed. By determining the current screen resolution and size and then scaling the image, the image can be displayed at the correct size.

3 Claims, 2 Drawing Sheets

CONSTANT SIZE IMAGE DISPLAY INDEPENDENT OF SCREEN RESOLUTION

FIELD OF THE INVENTION

The present invention relates generally to web pages and more specifically to a web page display that maintains the size of an image being displayed independent of the physical screen size and the resolution of the display.

BACKGROUND OF THE INVENTION

Today computer display devices have a wide range of available screen resolutions. Some of the standard resolutions are 640×480, 800×600, 1024×768, and 1152×768. Each of these resolutions gives the number of pixels that are displayed in the width and height of the display area. For example the 640×480 resolution displays 640 pixels across the width of the display and 480 pixels across the height of the display. These screen resolutions are typically independent of the actual size of the display area. For example a 15-inch monitor can use a resolution of 1024×768 and a 21-inch monitor can use a resolution of 640×480.

The display driver is the software running on the computer that knows about the hardware of the display device. The display driver typically knows the physical size of the display, the refresh rate of the display, the amount of video memory in the display device, the bit depth or number of colors that can be displayed, and the supported resolutions for the display device. These settings, including the resolution used for the display, can typically be changed by the user by adjusting the display driver.

Web browsers, for example Microsoft's Internet Explorer®, display web pages. The web page, when loaded, tells the web browser how and what to display. Typically this description of what the web page should look like is stored in a web page description language like HyperText Markup Language (HTML). The HTML document that describes a web page typically defines where all elements of the web page should be located. Web pages can contain text elements, graphic elements, as well as video and audio elements. The graphic elements can be bitmap images and vector objects like drawing. There are a number of parameters that can be specified when using HTML to display an image. Some of the parameters are 1) the image starting location 2) the way the text wraps the image 3) the height and width of the image. Currently there are two ways to display an image using HTML.

The first method is to specify a percent of the width and height of the web browser window. The second method is to specify the number of pixels for the width and height of the image. Each of these methods can cause problems when displaying images on different sized displays or same sized displays using different resolutions.

Displaying an image with HTML by specifying the percentage of the web browser window can cause the image to be non-proportionally scaled. Only integer values of the percent of the height and width of the web browser are available for use. When the web browser's height and width do not scale to the image height and width by an integer value, the image will be scaled by a different value in the height and width. The stretched or distorted non-proportionally scaled image can diminish the impact of using an image in the web page. Precise control over the layout of the page to be displayed cannot be achieved because the integer value requirement limits the height and width control to one percent of the height and width of the web browser.

Even when the image is an integral size of the web browser for a given web browser size, the web browser does not maintain a constant size or a constant width to height ratio. For example when the web browser is changed from "normal" view to "full screen" view the web browser typically changes its display aspect ratio. The aspect ratio is the ratio of the width to the height of a web page.

Displaying an image in a web page by specifying the number of pixels for the image height and width allows the image to remain the same size when the web browser is resized. But the size of the image is different depending on the current resolution of the display driver. For example an image that is 4×4 inches on a 17-inch monitor using a resolution of 1280×1024 would be 8×8 inches on the same monitor when using a resolution of 640×480. A potential difference of 2 to 1 in image sizes makes it difficult to create a page layout by specifying the image size using the number of pixels for the height and width. Having an image displayed at half the size that the user desired makes the image much harder to see and causes the image to lose impact.

Accordingly there is a need for a web page display that maintains the size of an image being displayed independent of the physical screen size and the resolution of the display.

SUMMARY OF THE INVENTION

The present invention is a method and apparatus for displaying images on web pages at a constant size or at a constant proportion of the screen size, independent of screen resolution and independent of physical screen size. By determining the current screen resolution and size and then scaling the image, the correct image size can be maintained.

DETAILED DESCRIPTION OF THE PREFERRED EMBODIMENT

The present invention is a method and apparatus for displaying images on web pages at a constant size or at a constant proportion of the screen size, independent of screen resolution and independent of physical screen size. By determining the current screen resolution and size and then scaling the image, the correct image size can be maintained.

The main problem today is that a page that is described using HTML, to be displayed on a web browser, does not have visibility of the display driver. Without visibility of the display driver the HTML page is unable to access the current settings of the display drive. These settings include the current display resolution.

A Java applet can be embedded into the HTML description of the page to be displayed. A Java applet is like a program. When a web browser is reading an HTML description of a page and encounters a Java applet, program control is passed to the Java applet. The Java applet executes and then passes program control back to the web browser. Java applets have visibility of the display driver. This allows Java applet to determine the current settings of the display driver.

Figure 1:
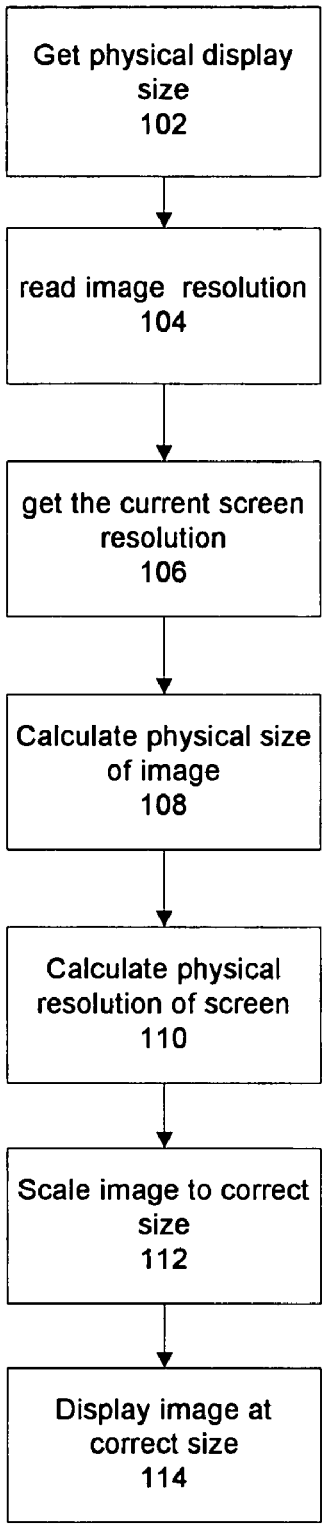
FIG. 1 is a flow chart of a method to display an image, embedded in a web page, at a desired size in accordance with the present invention.
Figure 2:
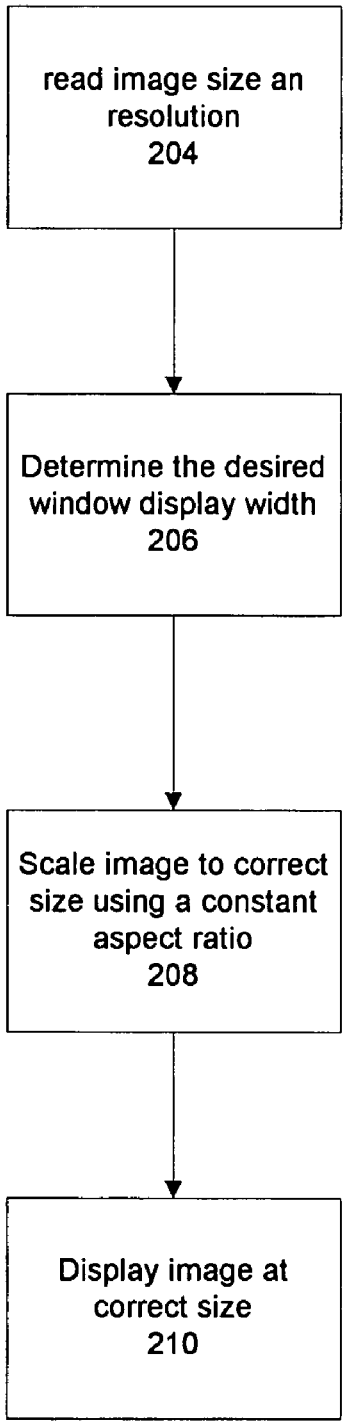
FIG. 2 is a flow chart of a method to display an image, embedded in a web page, at a fixed percent of the width of the display window using a constant aspect ratio in accordance with the present invention.

FIG. 1 is a flow chart showing the steps the Java applet uses to display an image at a desired size. The Java applet retrieves the physical display size (102), then reads the image resolution (104). The applet then gets the current settings of the display driver (106). Using the information from the previous steps the applet calculates the physical size of the image (108) and the physical resolution of the screen (110). Using the display attributes and the desired image size, the correct scaling for the image to be displayed can be calculated (112). The Java applet can then display the image at the correct size (114).

The code for the constant size image embodiment of the current invention is included in appendix A. Page 12, line 8 is the HTML source for the page to be displayed. On line 12 of page 12 the Java applet is embedded into the HTML page. The HTML page also contains the name and path to the image to be displayed (line 20, page 12). For this example embodiment the physical height and width of the screen is embedded into the HTML source (page 12, line 21). In the actual operation of the invention the physical height and width of the screen would be input by the user and stored in a file at a known location. If the Java applet did not detect the file the applet would ask the user for this information and then store the physical size and width at the known location.

The code for the Java applet that is launched by the HTML page starts at line 4 on page 9. The Java applet reads the image data and physical height and width from the HTML page (lines 26–40 of page 9). The applet then creates a container where it will display the image (line 45 page 9). The applet then launches a second Java applet called CSPanel (line 1 page 10). The code for the CSPanel applet starts on line 10 of page 10. The CSPanel applet reads the x and y resolution of the image from the header of the JPEG image file. Many image files used on the Internet are currently stored in the JPEG file format, however in the actual embodiment of the current invention a number of file types could be supported. A JPEG file was used in the example embodiment for clarity of understanding.

The "paintComponent" function of the example embodiment starts on page 11, line 16 of appendix A. The "paintComponent" function in a program operating in the Microsoft Windows® environment is responsible for controlling the display area that the program is using. The operating system sends a paintComponent request to the program each time that the display area needs to be refreshed. For example, a paintComponent request is sent to the program when the program window is resized or moved.

Each time the paintComponent function is called the logical screen resolution is retrieved from the display driver (line 22–23 page 11). The physical size of the image is calculated on lines 26–29 of page 11. The size of the image for the example embodiment is based on the scanned resolution of the image. In the actual embodiment a new field can be added to the image header file to store a desired image display size. For example, display this image 4.5 inches in width. This new field could be used instead of the scanned image resolution, allowing more control over the displayed size of the image.

The physical resolution of the screen is calculated on lines 32–33 of page 11. This resolution is what changes when the user switches between 640×480 and 1024×768 on the same physical screen. Using the physical resolution of the screen the logical width and height of the image is calculated (lines 36,37 of page 11). The logical width and height is used to draw the image to the screen at the correct size independent of screen resolution or physical screen size (line 49 of page 11).

For web page layout design it may be desirable to display an image at a constant percent of the web browser window width or height, while maintaining a constant image aspect ratio. A second embodiment of the current invention would display an image at a constant percent of the web browser window width. In this embodiment the physical screen height and width are not used. The desired image display width (206) is the total display width of the web browser times the percentage of the display width to be used by the image. The scale factor would be used to scale the image (208) in both the width and height to maintain a constant image aspect ratio. For example, when the desired image display width is 80 percent of the browser window width, the browser window width is 1000 pixels, and the image is 400 pixels wide, the scale factor would be 400/(1000*0.80) =½. When the image display width is set as a percent of the browser window display width, the image will not be re-scaled when the web browser window height is changed. The image size can be controlled using either a percent of the web browser window width or a percent of the web browser window height.

Appendix B contains the code for an example embodiment of a Java applet that displays an image in a web page at a constant percent of the browser window in accordance with the present invention. The source for the HTML page starts at line 18 of page 15. Embedded into this page is the name of the image (line 33 page 15), the path to the image (line 33 page 15), and the percent of the page width (line 33 page 15) to display the image. When this page is displayed it launches the embedded Java applet TestApplet (line 30 page 15). The code for TestApplet starts on line 4 of page 13. TestApplet reads the image and percent of width information from the HTML page and then launches a second Java applet called TestPanel (line 39 page 13). The code for the Java applet TestPanel starts on line 46 of page 14. TestApplet contains the paintCompnent that is called by the operation system each time the screen needs to be refreshed. TestPanel scales the image to the percent of the page width or the percent of the page height which ever one is set (lines 35–50 page 14) and then displays the image at the correct size (lines 5–12 page 15).

The foregoing description of the present invention has been presented for purposes of illustration and description. It is not intended to be exhaustive or to limit the invention to the precise form disclosed, and other modifications and variations may be possible in light of the above teachings. For example, any programmatic control that has visibility of the display driver could be used instead of the Java applet. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A method of displaying an image in a web page, comprising the steps of:

embedding a program in the web page that, when launched, determines the physical size of the display and the current resolution of the display;

determining the desired physical size of the image to be displayed;

displaying the image at the desired physical size.

2. A web page comprising:

an embedded program launched when the web page is read, the embedded program configured to determine the current display resolution for a display used to display the web page, wherein the embedded program also determines the physical size of the display.

3. The web page of claim 2 further comprising:

at least one image to be displayed by the web page, the image having a desired physical size, whereby the image is displayed at the desired physical size of the image by scaling the image to compensate for the current display resolution and the physical size of the display.

* * * * *